United States Patent [19]

Severijns et al.

[11] 4,047,394

[45] Sept. 13, 1977

[54] $^3$HE-$^4$HE DILUTION REFRIGERATING MACHINE

[75] Inventors: Adrianus Petrus Severijns; Franciscus Henricus Eduard Aarts, both of Eindhoven, Netherlands

[73] Assignee: U.S. Philips Corporation, New York, N.Y.

[21] Appl. No.: 673,007

[22] Filed: Apr. 2, 1976

[30] Foreign Application Priority Data

Apr. 24, 1975 Netherlands ..... 7504835

[51] Int. Cl.$^2$ ..... F25B 19/00

[52] U.S. Cl. ..... 62/502; 62/514 R

[58] Field of Search ..... 62/114, 476, 502, 514 R; 137/469, 510

[56] References Cited

U.S. PATENT DOCUMENTS

| | | | |
|---|---|---|---|
| 3,726,301 | 4/1973 | Schmidt | 137/469 X |
| 3,922,881 | 12/1975 | Staas et al. | 62/514 R |
| 3,978,682 | 9/1976 | Severijns et al. | 62/514 R |

*Primary Examiner*—Ronald C. Capossela
*Attorney, Agent, or Firm*—Frank R. Trifari; Rolf E. Schneider

[57] ABSTRACT

A $^3$He-$^4$He dilution refrigerator provided with a variable-flow restriction member in the supply duct for flowing the condensed helium into the mixing chamber, such member being controlled by the flow of condensed helium and having a flat flow passage curve.

3 Claims, 2 Drawing Figures

$^3$HE-$^4$HE DILUTION REFRIGERATING MACHINE

This invention relates to a $^3$He-$^4$He dilution refrigerating machine for very low temperatures, comprising a pumping device whose delivery side communicates, via at least one precooling device and at least one condenser wherein a gas flow consisting for the major part of $^3$He condenses during operation, with a supply duct for concentrated $^3$He which includes at least one flow-restricting member across which member a pressure difference prevails during operation, the supply duct opening into a mixing chamber for $^3$He and $^4$He which is connected, via a connection duct for diluted $^3$He which is in heat-exchanging contact with the supply duct, to a separation reservoir for separating diluted $^3$He into $^3$He and $^4$He, the said reservoir including a gas outlet for substantially $^3$He which is connected to the intake side of the pumping device.

A dilution refrigerating machine of the kind set forth is known from the article "Principles and methods of dilution refrigeration" (Physics Vol. 4, No. 1, pages 1-64, 1968), notably from FIG. 13.

The flow-restricting member in the known refrigerating machine is a fixed flow restriction consisting of a capillary tube (internal diameter 100 microns) wherein a tightly fitting wire has been inserted. A tube filled with powder may be alternatively used for the fixed flow restriction.

The fixed flow restriction, situated downstream from the condenser, ensures that during normal operation of the machine adequate pressure is built up in the condenser for complete condensation of the supplied gas flow and also conducts only so much condensate that the condenser does not become empty. During normal operation gas is prevented from penetrating into the portion of the supply duct which exchanges heat with the connection duct; this would otherwise seriously affect the heat exchange between the concentrated $^3$He and the colder, diluted $^3$He flowing in the connection duct.

The fixed flow restriction is normally cooled, for example, by a heat exchanging contact with the separating reservoir in order to minimize viscous heating of concentrated $^3$He in the said flow restriction. The viscous heating and the resultant temperature rise of the $^3$He can be significant because of the high viscosity of $^3$He at low temperatures.

The known dilution refrigerating machine has the drawback that a long cooldown is required at the start before the desired low operating temperature is reached.

The invention has for its object to provide an improved dilution refrigerating machine of the kind set forth wherein a substantially reduced cooling period is automatically realized in a structurally simple manner, and also reduced viscous heating is obtained.

To this end, the $^3$He-$^4$He dilution refrigerating machine in accordance with the invention is characterized in that the flow-restricting member is a control member which is operated by the incoming flow and which, at pressure differences exceeding a threshold value, allows the flow to pass substantially independently of the said pressure differences.

A control member of this kind thus has a substantially flat flow passage curve beyond the threshold value of the pressure difference. Graphically this means that, when the pressure difference is plotted on a vertical axis and the passed flow is plotted on a horizontal axis (for example, in moles/second), the flow passage curve is substantially flat for pressure difference values in excess of the threshold value.

The invention is based on the recognition of the fact that the pumping device in the known dilution refrigerating machine causes only a limited flow to circulate during the starting period, primarily because of the high impedance then formed by the fixed flow restriction for the low-density $^3$He-$^4$He gas mixture.

In the dilution refrigerating machine in accordance with the invention, automatic control takes place so that during the cooling period in which gaseous $^3$He-$^4$He mixture flows to the control member, the control member provides a pressure build-up in the condenser, but forms only a low impedance for the gas mixture. This means that at the start a large gas flow is circulated without a pumping device having a high pumping capacity being required; this results in a substantial reduction of the cool-down time.

The fact that the control is automatic is particularly advantageous because in practice usually small flows (for example, $1.5\times10^{-4}$ mol./s concentrated $^3$He) are difficult to control accurately from outside the dilution refrigerating machine.

Because the control member now has a low impedance also during the starting period, virtually no viscous heating of the $^3$He flowing through the control member takes place during this period; this directly benefits the cooling power.

The control member is particularly advantageous for the dilution refrigerating machine known from U.S. Pat. No. 3,835,662 in which, besides $^3$He, also superfluid $^4$He is circulated, which is derived from the separating reservoir via a superleak and which is subsequently injected into an auxiliary mixing chamber which is in open communication with or which forms part of the mixing chamber. Due to the circulation of superfluid $^4$He, the circulation of $^3$He and hence the cooling power are substantially increased.

The circulation of $^4$He is switched on after a normal circulation of liquid $^3$He (for example, $1.5 \times 10^{-4}$ mol/s) has been obtained. When the $^4$He circulation is switched on, the pumping device must handle a much larger $^3$He flow, for example, more than ten times the normal flow, at a higher suction pressure. In the case of a fixed flow restriction on the delivery side of the pumping device, the pumping device would then have to pump against a high pressure of, for example, 4 atmospheres. This would necessitate the use of an additional compressor and would hence involve the risk of substantial $^3$He gas leakage and the disappearance of the $^3$He filling from the mixing chamber by storage in the dead volume present on the delivery side of the pumping system. Thanks to the control member and its flat flow passage curve, the handling of the increased $^3$He flow is improved because the increased $^3$He flow passes the low-impedance control member without obstruction.

In accordance with the invention, the control member is preferably constructed so that the threshold value of the pressure difference can be adjusted. The condensation pressure in the condenser and the control range of the $^3$He flow can thus also be influenced in a simple manner.

The invention will be described in detail hereinafter with reference to the accompanying drawings, in which.

Figure 1:
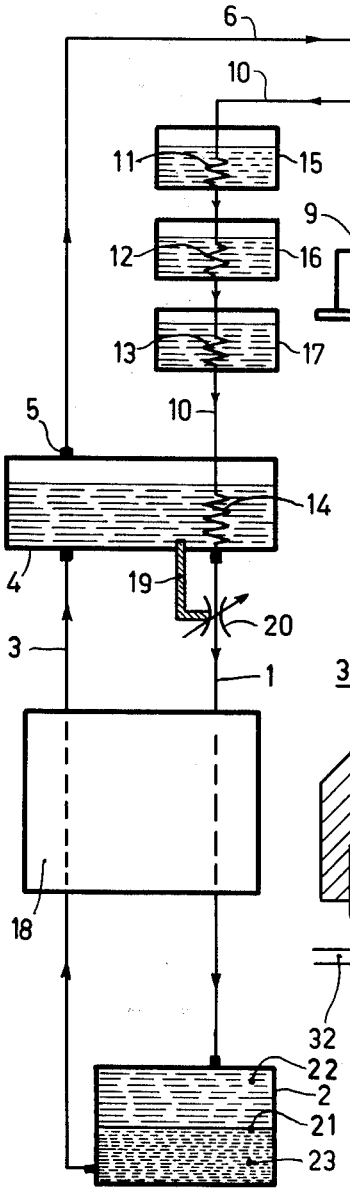
FIG. 1 is a diagrammatic representation of a $^3He$-$^4He$ dilution refrigerating machine, including a control member which is operated by the incoming $^3He$ flow and which has a flat flow passage curve for pressure differences in excess of a given threshold value.

The reference 1 in FIG. 1 denotes a supply duct which opens into a mixing chamber 2 which communicates, via a connection or return duct 3, with a separating reservoir 4 having an outlet 5.

The outlet 5 is connected, via a suction duct 6, to a diffusion pump 7 to which a rotation pump 8 is connected. The outlet 9 of the rotation pump 8 communicates, via a duct 10, with the supply duct 1. The duct 10 includes heat exchangers 11, 12, 13 and 14 which are situated inside the reservoirs 15, 16, 17 and the separating reservoir 4, respectively.

Concentrated $^3He$ condenses and is further precooled in the said heat-exchangers. For example, the reservoir 15 is filled with liquid nitrogen (78° K), whilst the reservoirs 16 and 17 contain liquid helium at 4.2° K and, for example, 1.3° K, respectively.

A heat exchanger 18 is included on the one side in the supply duct 1 and on the other side in the connection duct 3.

Furthermore, the supply duct 1 includes a control member in the form of a variable restriction 20 which is cooled by the separating reservoir 4, via a readily heat-conducting connection 19, and which is controlled by the flow originating from the heat exchanger 14. Beyond a threshold value of the pressure difference between the inlet and the outlet of the restriction 20, the conducted flow is substantially independent of the pressure difference across the restriction, i.e. the restriction has a flat flow passage curve. This means that beyond the threshold value, for any pressure difference occurring the associated flow is allowed to pass substantially without obstruction, because the restriction then only has a low impedance. This, during the starting period of the machine to reach the low operating temperature, a large flow of $^3He$-$^4He$ gas mixture will be circulated, due to the low impedance of the restriction 20, by the pumping system 7, 8, so that the low operating temperature will be reached in a very short period of time.

By way of illustration the operation of the dilution refrigerating machine during normal operation, i.e. at the low operating temperature, will be briefly described hereinafter.

During operation, substantially pure $^3He$ gas, supplied to the duct 10 by the rotation pump 8, condenses in the heat exchangers 11 to 14 and its temperature is lowered to about 0.7° K. The condensed, concentrated $^3He$ is subjected to a further temperature drop in the heat exchanger 18, and subsequently enters the mixing chamber 2 containing two phases 22 and 23 respectively of concentrated $^3He$ and superfluid diluted $^3He$ ($^3He$ dissolved in $^4He$), separated by an interface 21. The transition of $^3He$ from the phase 22, via the interface 21, to the phase 23 has a cooling effect. The $^3He$ which has passed the interface 21 is transported in the diluted phase, via the connection duct 3, to the separating reservoir 4, and during this transport it cools in the heat exchanger 18 the concentrated $^3He$ which is on its way to the mixing chamber 2. In the separating reservoir 4, the diluted $^3He$ is separated into $^3He$ and $^4He$. The substantially pure $^3He$ is sucked off by the pumping system consisting of the diffusion pump 7 and the rotation pump 8 through outlet 5 and suction duct 6, and is subsequently fed to the duct 10 again.

The condensation and the precooling of the concentrated $^3He$ can be effected using means other than a bath of liquid nitrogen and two baths of liquid helium, whilst other pumping systems, operating at room temperature or not, are also feasible.

Furthermore, a plurality of heat exchangers, for example, including sintered copper heat exchangers, can also be included in the supply and the connection ducts.

Figure 2:
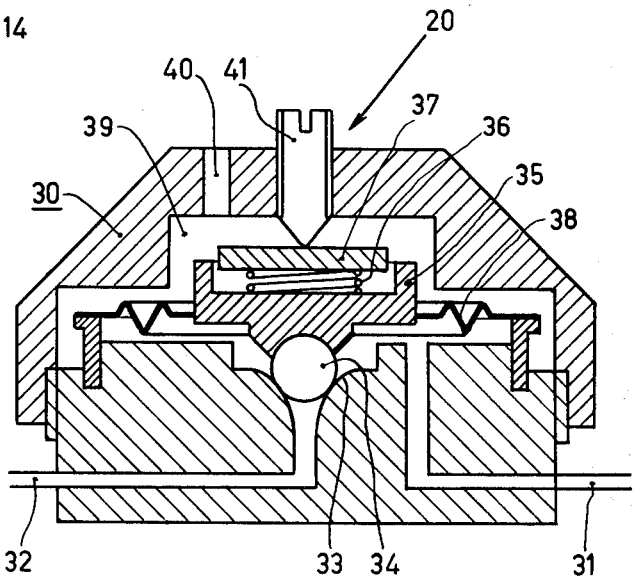
FIG. 2 is a sectional view of an embodiment of the control member of the machine shown in FIG. 1.

The control member 20 shown in FIG. 2 comprises a housing 30, for example, of copper with an inlet 31 and an outlet 32 wherebetween a valve seat 33 is arranged. A ball 34, rigidly connected to a body 35, cooperates in a sealing manner with the seat 33. The body 35 accommodates a flexible compression spring (low spring constant) 36 and a plate 37.

The assembly formed by the ball 34, the body 35, the spring 36 and the plate 37 is supported by a diaphragm 38 of, for example, stainless steel (thickness, for example, 100 microns). Above the said assembly and the diaphragm 38 there is present a chamber 39 which can be connected, via a bore hole 40, to a space of constant, low pressure. For this space the vacuum space (not shown) in which the dilution refrigerating machine of FIG. 1 is usually accommodated can be chosen. The force of the spring 36 can be adjusted by means of an adjusting screw 41.

During operation, the ball 34 is lifted off the seat 33 by the pressure exerted, against spring pressure, on the lower side of the diaphragm 38 by the medium entering the inlet 31.

Due to the low spring constant of the spring 36, the control member has a flat flow passage curve beyond a pressure which only slightly exceeds the opening pressure.

Obviously, besides the control member shown a variety of alternative embodiments are feasible.

What is claimed is:

1. A $^3He$-$^4He$ dilution refrigerator operable with a supply of gaseous helium, which comprises pump means for compressing and circulating said gaseous helium, means for cooling and condensing the compressed helium, a heat exchanger for further cooling the condensed helium, a mixing chamber for receiving the cooled condensed helium for separation into a liquid concentrated $^3He$ phase and a liquid diluted $^3He$ phase, a supply duct for flowing the condensed helium from said cooling and condensing means through said heat exchanger to said mixing chamber, a separating reservoir for receiving the liquid diluted $^3He$ phase for separation into gaseous $^3He$ and liquid $^4He$, a return duct for flowing said liquid diluted $^3He$ phase from said mixing chamber through said heat exchanger in heat-exchange relation with said supply duct to said separating reservoir, a suction duct for flowing said gaseous $^3He$ from said separating reservoir to said pump means, and a variable-flow restriction member positioned in said supply duct between said cooling and condensing means and said heat exchanger, said variable-flow restriction member being operated by the flow of condensed helium and, at a pressure difference exceeding a threshold value, allowing said flow of condensed helium to pass substantially independently of said pressure difference.

2. A refrigerator according to claim 1, which includes means for adjusting said variable-flow restriction member to vary said threshold value.

3. A refrigerator according to claim 1 in which said variable-flow restriction member comprises a spring-loaded ball-valve flow-control device.

* * * * *

UNITED STATES PATENT AND TRADEMARK OFFICE

CERTIFICATE OF CORRECTION

PATENT NO. : 4047394

DATED : Sept. 13, 1977

INVENTOR(S) : ADRIANUS PETRUS SEVERIJNS ET AL

It is certified that error appears in the above-identified patent and that said Letters Patent are hereby corrected as shown below:

Column 3, line 39, "This" should be --Thus--

Signed and Sealed this

*Tenth* Day of *January 1978*

[SEAL]

*Attest:*

RUTH C. MASON
*Attesting Officer*

LUTRELLE F. PARKER
*Acting Commissioner of Patents and Trademarks*